US005845182A

United States Patent [19]

Johroku et al.

[11] Patent Number: 5,845,182

[45] Date of Patent: Dec. 1, 1998

[54] TONER CARTRIDGE FOR AN IMAGE FORMING APPARATUS HAVING STIRRING ROD WITH BEARING

[75] Inventors: Kazuo Johroku; Tsukasa Ichimaru; Yoshifumi Okauchi, all of Osaka, Japan

[73] Assignee: Mita Industrial Co., Ltd., Osaka, Japan

[21] Appl. No.: 870,587

[22] Filed: Jun. 6, 1997

Related U.S. Application Data

[63] Continuation-in-part of Ser. No. 652,040, May 23, 1996, abandoned.

[30] Foreign Application Priority Data

May 23, 1995 [JP] Japan ..... 7-123477

[51] Int. Cl.[6] ..... G03G 15/08

[52] U.S. Cl. ..... 399/256; 399/263

[58] Field of Search ..... 399/102–106, 399/256, 263, 254, 255; 384/905.1, 245, 246, 456, 548, 418, 445; 366/608, 241, 279, 342

[56] References Cited

U.S. PATENT DOCUMENTS

| | | | |
|---|---|---|---|
| 1,541,410 | 6/1925 | Cowley | 384/905.1 |
| 2,300,362 | 10/1942 | Shotter . | |
| 3,020,104 | 2/1962 | Nichols . | |
| 3,052,504 | 9/1962 | Wind . | |
| 3,232,681 | 2/1966 | Mittmann . | |
| 3,300,260 | 1/1967 | Stern . | |
| 3,596,807 | 8/1971 | Hudson et al. . | |
| 4,344,692 | 8/1982 | Oda | 399/254 |
| 4,583,842 | 4/1986 | Shimono et al. | 399/256 |
| 4,842,423 | 6/1989 | Bhagwat . | |
| 5,115,276 | 5/1992 | Miskinis et al. | 399/272 |
| 5,124,752 | 6/1992 | Kanno et al. | 399/53 |
| 5,134,441 | 7/1992 | Nagata et al. | 399/103 |
| 5,143,017 | 9/1992 | Haneda et al. . | |
| 5,166,731 | 11/1992 | Aimoto et al. . | |
| 5,594,541 | 1/1997 | Bonislawski, Jr. et al. | 399/358 |

FOREIGN PATENT DOCUMENTS

| | | |
|---|---|---|
| 0 496 602 A1 | 7/1992 | European Pat. Off. . |
| 0 514 874 A3 | 11/1992 | European Pat. Off. . |
| 0 676 675 A2 | 10/1995 | European Pat. Off. . |
| 0 682 297 A2 | 11/1995 | European Pat. Off. . |

OTHER PUBLICATIONS

Patent Abstracts of Japan v 010, n 086 (P–443), 4 Apr. 1986 & JP–A–60 222878, 7 Nov. 1985.

*Primary Examiner*—Robert Beatty

*Attorney, Agent, or Firm*—Shinjyu An Intellectual Property Firm

[57] ABSTRACT

A toner cartridge for an image forming apparatus includes a toner storing unit having two flexible stirring rods disposed therein. Two tapered bearing portions disposed on a first side wall of the toner storage unit extend partially into the first side wall without piercing the first side wall, and two bearing portions on a second side wall extend completely through the second side wall. First ends of each of the stirring rods is tapered and fits into the tapered bearing portions on the first side wall of the toner storage unit. Second ends of the stirring rods extend through the bearing portions of the second side wall of the toner storage unit. Flange members are disposed on the second ends of the stirring rods, and a seal is interposed between each flange member and the second side wall. In another embodiment of the present invention, two of the bearing portions on the first side wall are generally square, and the first ends of the stirring rods have a generally spherical tip. The second ends of the stirring rods also include generally spherical portions which are in contact with the two bearing portions on the second side wall.

20 Claims, 8 Drawing Sheets

TONER CARTRIDGE FOR AN IMAGE FORMING APPARATUS HAVING STIRRING ROD WITH BEARING

This application is a continuation-in-part of application Ser. No. 08/652,040, filed May 23, 1996, now abandoned.

BACKGROUND OF THE INVENTION

A. Field of the Invention

The present invention relates to a toner cartridge for an image forming apparatus for supplying toner to a developing device in the image forming apparatus.

B. Description of the Related Art

In an image forming apparatus such as a copying machine, an image of an original document is generally obtained by an exposure device, and an electrostatic latent image is then formed on the outer circumference of a photosensitive drum. A developing device for forming a toner image on the photosensitive drum is disposed around the photosensitive drum. The developing device includes a toner hopper for supplying toner, and a toner cartridge detachably connected to the toner hopper. When the toner in the toner cartridge is depleted, the tones cartridge can be replaced with a new one.

A toner cartridge generally includes a toner storage unit for storing tones, the toner storage unit having an opening in it that allows toner to be discharged into the toner hopper. These types of toner cartridges may also include one or more stirring rods disposed inside the toner storage unit. In these types of toner cartridges, the stirring rod is often made longer than the length of the toner storage unit so as to allow at least one end of the stirring rod to extend outside the walls of the toner cartridge. One end of the stirring rod is typically driven by a motor disposed outside of the toner cartridge.

This type or toner cartridge also includes a first and a second aperture for rotatably supporting the stirring rod, with the apertures extending through the walls of the toner storage unit. The stirring rod is inserted into the toner storage unit, with the end portions of the stirring rod extending through the first and second apertures.

In the above-described toner cartridge, the apertures must be at least as wide as the widest portion of the stirring rod. Therefore in order to rotatably support the stirring rod and to prevent toner from leaking out of the toner cartridge, bearing portions must be fitted to each end of the stirring rod. Because at least one of these bearing portions is installed after the stirring rod is inserted into the toner cartridge, an additional assembly step is necessary, which complicates the assembly process and increases the possibility of defective construction. When defects do occur, the result is often a toner cartridge that leaks because of an ineffective seal between the stirring rod and the walls of the cartridge body.

SUMMARY OF THE INVENTION

It is therefore one object of the present invention to provide a toner cartridge for an image forming apparatus in which the toner cartridge can be more easily assembled while reducing the possibility of toner leakage.

According to one embodiment of the present invention, a toner cartridge for an image forming apparatus includes a toner storage unit, which includes a first side wall and a second side wall. The first side wall includes at least one first bearing portion and the second side wall includes at least one second bearing portion. The first bearing portion partially extends into said first side wall, and said second bearing portion extends through said second side wall. At least one flexible stirring rod is disposed within the toner storage unit, which includes a first end portion and a second is end portion. The first end portion is rotatably supported by the first bearing portion, and the second end portion is rotatably supported by the second bearing portion and extends through the second side wall.

According to another embodiment of the present invention, first side wall of the toner cartridge includes two first bearing portions, and the second side wall includes two second bearing portions.

According to yet another embodiment of the present invention, the toner cartridge further includes a first stirring rod and a second stirring rod.

According to yet Another embodiment of the present invention, the stirring rod includes a rotatable rod and a spiral-shaped member fixed around the outer circumference thereof.

According to yet another embodiment of the present invention, the stirring rod further includes a rotatable rod and a paddle member fixed thereto.

According to yet another embodiment of the present invention, the stirring rod is composed of a resilient material.

According to yet another embodiment of the present invention, the stirring rod further includes a flange member attached to the second end portion thereof.

According to yet another embodiment of the present is invention, a seal member is disposed between said flange member and said second side wall.

According to yet another embodiment of the present invention, the first end portion of the stirring rod is tapered to an angle $\theta_2$, and interior walls of the first bearing portion are tapered to an angle of $\theta_1$, with the angle $\theta_2$ being greater than said angle $\theta_1$.

Because the number of apertures that extend through the walls of the toner storage unit is reduced, there is less opportunity for toner leakage. Moreover, the stirring rods and the seals can be easily inserted into the toner storage unit in one step. As a result, the possibility of mistakes during assembly is reduced, thereby reducing the possibility of toner leakage.

Other objects, features, aspects and advantages of the present invention will be apparent from the following detailed description of the present invention when taken in conjunction with the accompanying drawings, in which like reference numerals designate the same or similar parts throughout.

DETAILED DESCRIPTION OF THE PREFERRED EMBODIMENTS

Figure 1:
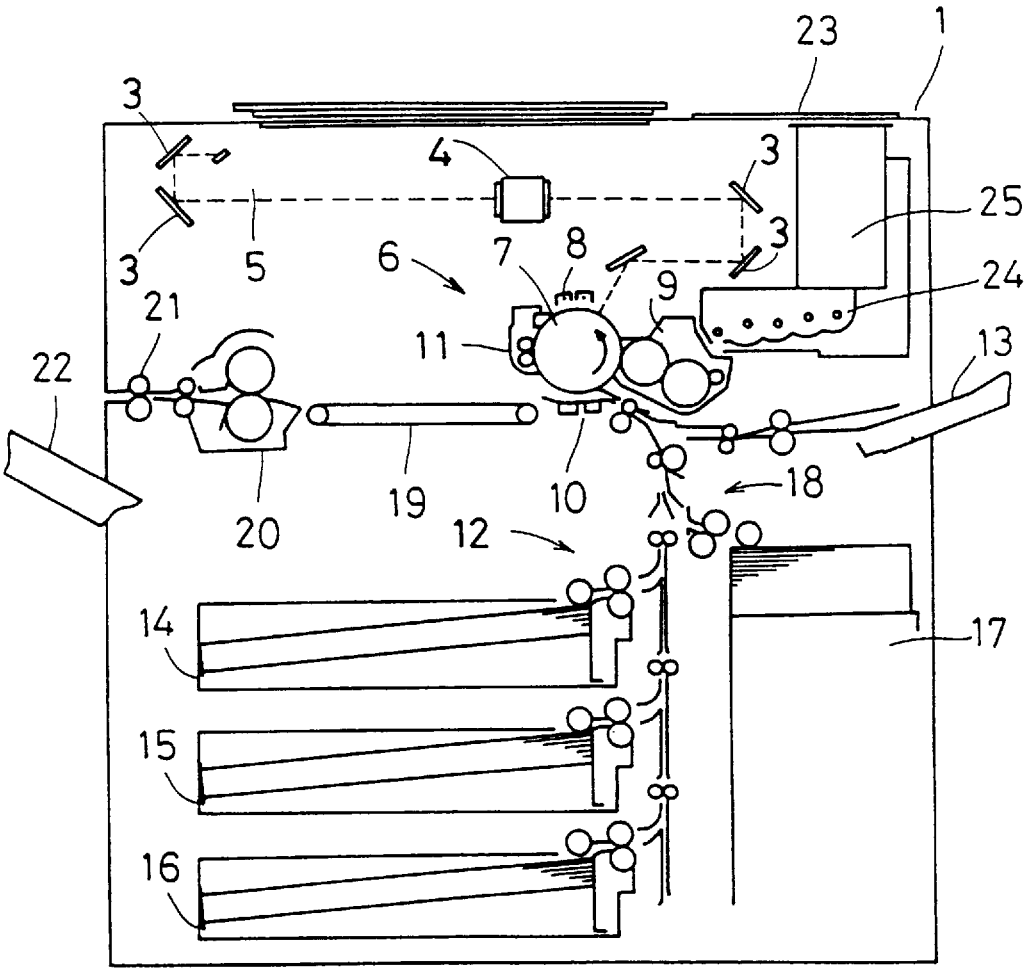
FIG. 1 is a side schematic view of a copying machine in accordance with one embodiment of the present invention.
Figure 2:
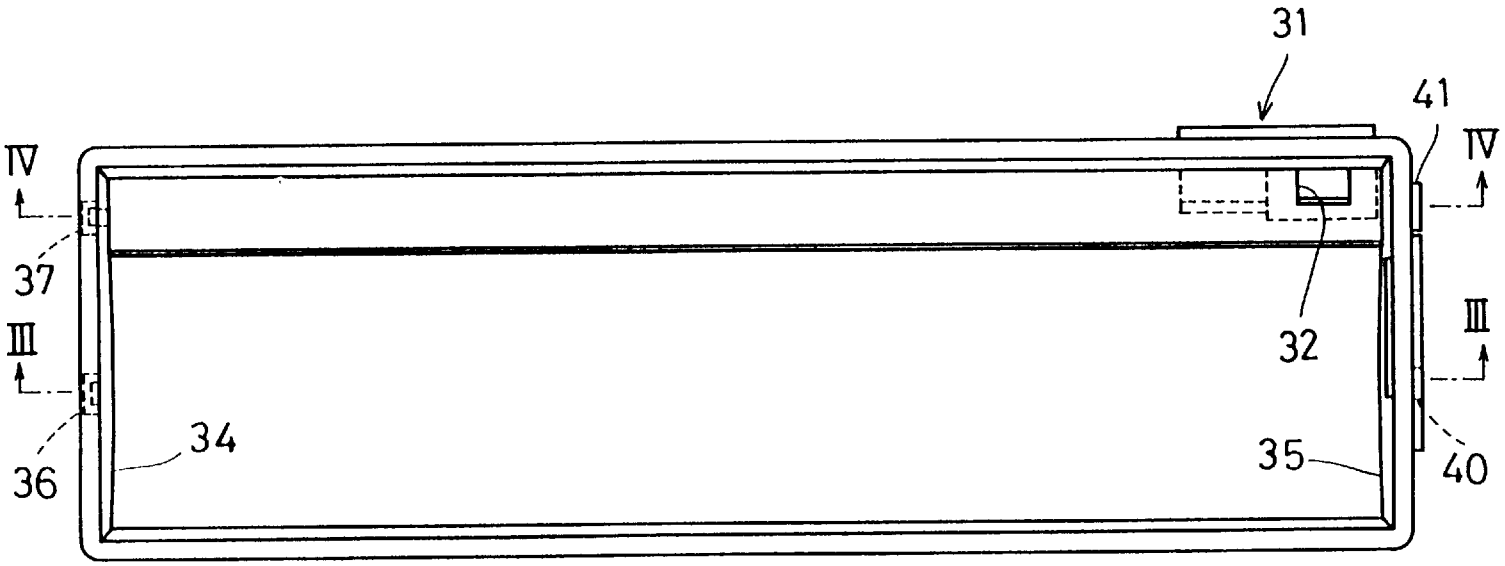
FIG. 2 is a plane view of a toner cartridge according to one embodiment of the present invention, with a first stirring rod, a second stirring rod and an upper cap removed for clarity.

A copying machine in accordance with one embodiment of the present invention is shown in FIG. 1. A control panel 23 is provided on the upper side of copying machine 1 and includes an input key section and display section. The upper portion of copying machine 1 includes an optical exposure system 5 for obtaining an image from an original document placed in an exposure area 2. The optical exposure system 5 includes a light source (not shown), mirrors 3 and at least one lens 4. Located in the central portion of the copying machine 1 is an image processor 6 for forming an toner image of the original document on a blank sheet of paper. Image processor 6 includes photosensitive drum 7, on the outer circumference of which an electrostatic latent image is formed. Surrounding the photosensitive dram 7, there is a main charger 8 for charging the photosensitive drum 7 with a predetermined level of electric charge, a developing device 9 for developing the electrostatic latent imager a transfer and detaching device 10 for transferring a toner image to a sheet of paper and detaching the sheet from the photosensitive drum 7, and a cleaning device 11 for removing excess toner from the photosensitive drum 7.

A paper supply unit 12 is located in the bottom portion of the copying machine 1. This paper supply unit 12 includes a bypass table 13, three paper cassettes 14, 15 and 16 arranged perpendicular to the bottom portion of copying machine 1, an oversized paper cassette 17, and a paper transporting device 18 for transferring the sheets stored in the bypass table 13 or paper cassettes 14–17 to the image processor 6. There is a sensor (not shown) located on the sides of each paper cassette 14–17 which allows the number of sheets of paper transferred from the paper cassettes 14–17 to be counted.

After a toner image has been transferred to a sheet of paper, the sheet is transferred to a paper discharge belt 19, and then to a fixing device 20 for fusing and fixing toner images onto the sheet, and finally to discharging rollers 21 which discharges the sheet into a copy tray 22.

A toner hopper 24 for supplying toner to the image processor 6 is attached to a developing device 9. A toner cartridge 25 is detachably connected to the toner hopper 24. One embodiment of the toner cartridge 25 is shown in FIGS. 2–7.

Figure 5:
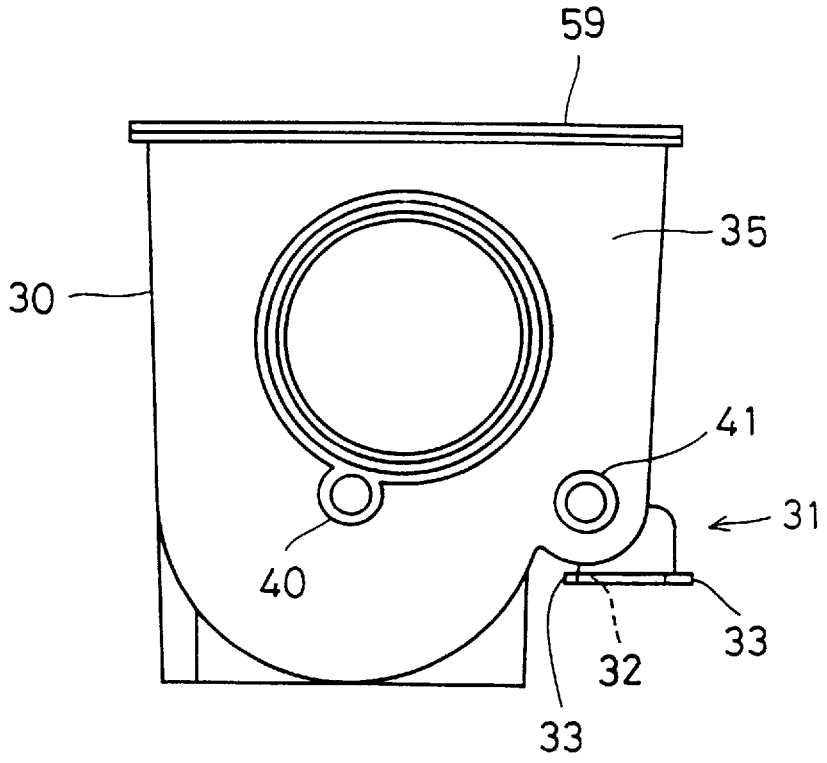
FIG. 5 is a side view of the toner cartridge depicted in FIG. 2.

As can be seen in FIG. 5, the toner cartridge 25 includes a generally rectangular toner storage unit 30 for storing toner therein. A toner discharge chute 31 is formed on the toner storage unit 30, and allows the toner to be discharged downward into the toner hopper 24. The toner discharge chute 31 includes a toner discharge opening 32 which extends into the toner storage unit 30, and shutter guides 33. A shutter member (not shown) is slidably attached to shutter guides 33, and allows the toner discharge opening 32 to be selectively opened to the toner hopper 24.

Figure 3:
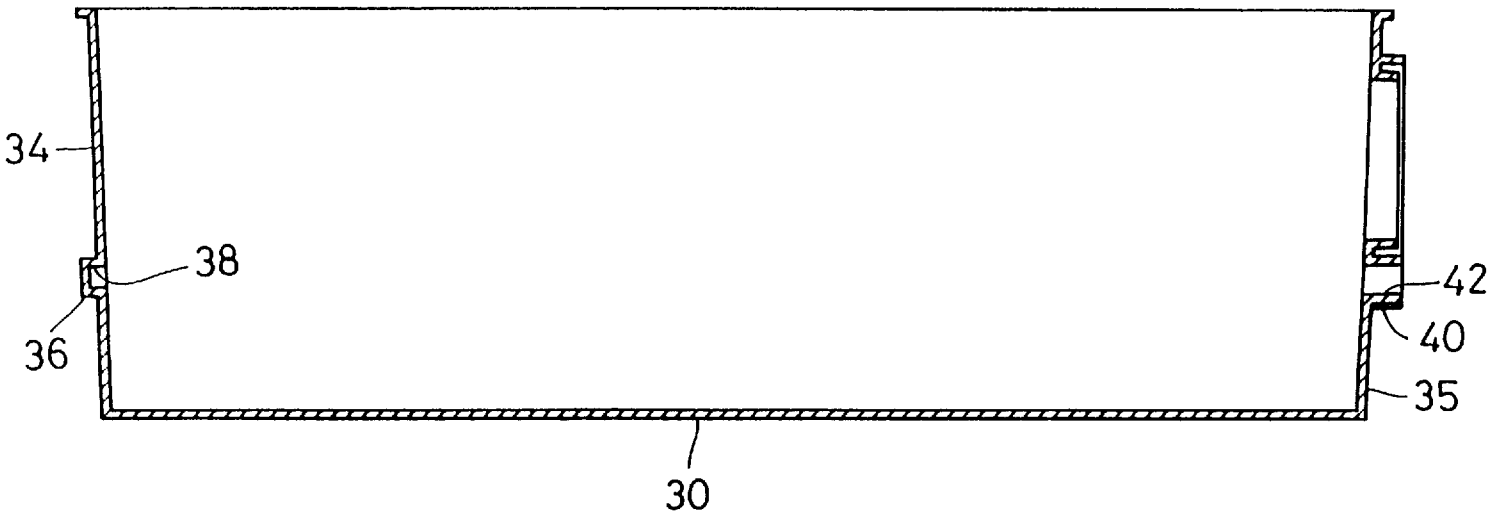
FIG. 3 is a cross sectional view of the toner cartridge depicted in FIG. 2, taken along the line III—III of FIG. 2 looking in the direction of the arrows.
Figure 4:
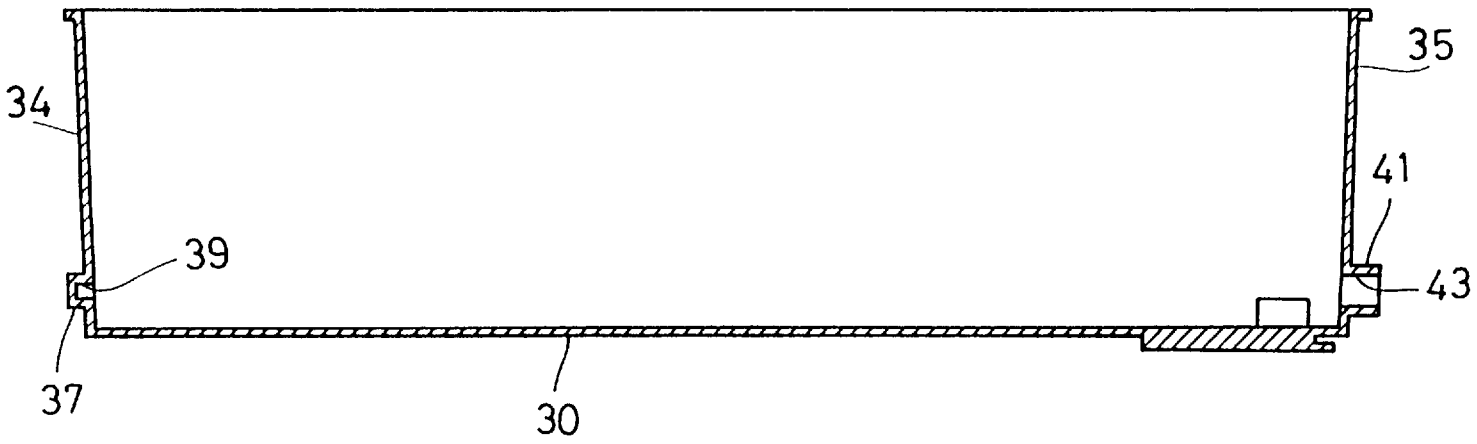
FIG. 4 is a cross sectional view of the toner cartridge depicted in FIG. 2, taken along the line IV—IV of FIG. 2 looking in the direction of the arrows.
Figure 6:
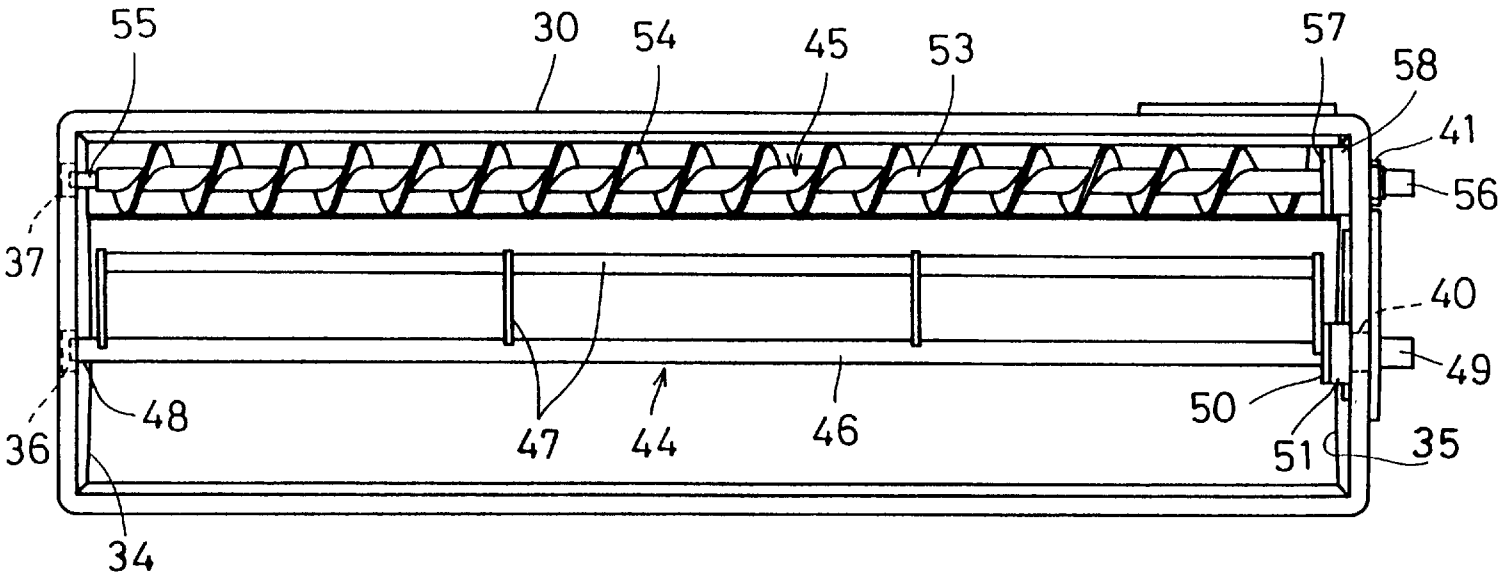
FIG. 6 is a plane view of the toner cartridge depicted in FIG. 2, with the upper cap removed for clarity but showing the first stirring rods.
Figure 7:
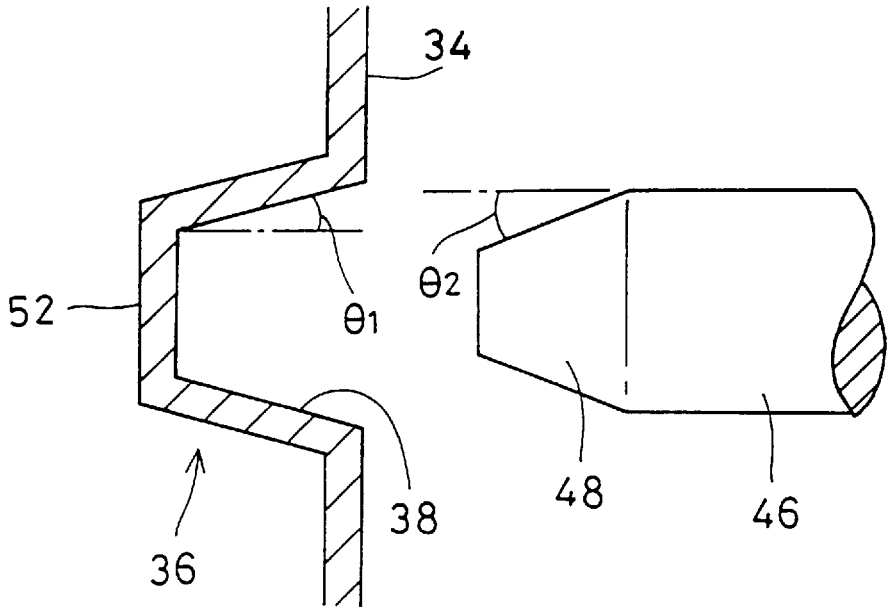
FIG. 7 is a part cross sectional, part perspective, part fragmentary view of a first bearing portion on a first side wall of the toner cartridge shown in FIG. 2, and a first end portion of a first stirring rod shown in FIG. 6.

As can be seen in FIGS. 2–7, the toner storage unit 30 further includes a first side wall 34 and a second side wall 35. FIGS. 2–4 and 6–7 show a first bearing portion 36 and a second bearing portion 37 disposed on the first side wall 34. As shown in FIGS. 3, 4, and 7, the first bearing portion 36 includes an first aperture 38 and the second bearing portion 37 includes a second aperture 39, both apertures partially extending through the first side wall 34. As shown in FIGS. 2–6, third bearing portion 40 and fourth bearing portion 41 are formed in the second side wall 35, and respectively oppose first and second bearing portions 36 and 37 on first side wall 34. Third bearing portion 40 include a third aperture 42, and fourth bearing portion 41 includes a fourth aperture 43. Both third and fourth apertures 42 and 43 extend completely through the second side wall 35.

As shown in FIG. 6, the toner storage unit 30 further includes a first stirring rod 44 and a second stirring rod 45. The first stirring rod 44 includes a first rotating axis 46 and a paddle 47 extending from the rotating axis 46. The first stirring rod 44 is flexible, and may be composed of any resilient material, such as synthetic plastic or metal. A first end portion 48 of first stirring rod 44 is rotatably supported by the first bearing portion 36. A second end portion 49 of the first stirring rod 44 is rotatably supported by and extends through the third bearing portion 40. A first flange 50 is disposed on the second end portion 49 of first stirring rod 44, the diameter of the first flange 50 being greater than the diameter of the third aperture 42. A first seal 51 is disposed between the first flange 50 and the second side wall 35 to prevent toner from leaking from the third aperture 42.

The second stirring rod 45 includes a second rotating axis 53 and a spiral-shaped member 54 disposed around the outer circumference thereof. The second stirring rod 45 is flexible, and may be composed of any resilient material, such as synthetic plastic or metal. A first and portion 55 of the second stirring rod 45 is rotatably supported by the second bearing portion 37. A second end portion 56 of the second stirring rod 45 is rotatably supported by and extends through the fourth bearing portion 41. A second flange 57 is disposed on the second end portion 56 of second stirring rod 45. A second seal 59 is disposed between the second flange 57 and the second side wall 35 to prevent toner leaking from the fourth aperture 43.

The relationship between the first bearing portion 36 and 5 the first end portion 48 of stirring rod 44 is shown in FIG. 7. The sides of first aperture 38 are tapered to an angle of $\theta_1$ relative to a bottom portion 52. The first end portion 48 of stirring rod 44 is tapered to an angle of $\theta_2$. The relation of $\theta_1$ to $\theta_2$ is $\theta_1<\theta_2$, for example, $\theta_1=1$ and $\theta_2=2$. It is to be understood that the relationship between second bearing portion 37 and the first end portion 55 of second stirring rod 45 is identical to that described above. Because the taper angles of the first aperture 38 and second aperture 39 are not identical to the taper angles on the first ends of the first stirring rod 44 and the second stirring rod 45, the amount of friction between the first ends of the first and second stirring rods 44 and 45 and their respective apertures is reduced. This allows the first and second stirring rods 44 and 45 to be rotated with a reduced amount of torque.

When the first stirring rod 44 is installed into the toner storage unit 30, the first seal 51 is placed around the second end portion 49 and the first end portion 48 is then inserted into the first aperture 38 of first beating portion 36. Because the length of the first stirring rod 44 is longer than the length of the toner storage unit 30, during installation the stirring rod 44 must be flexed so that the second end portion 49 may be inserted through the second aperture 42 of second bearing portion 40. The first flange 50 is fixed to the second stirring rod 44 such that the first seal 51 is securely held between the first flange 50 and the second side wall 35, thereby effectively sealing the third aperture 42.

It should be noted that the second stirring rod 45 is installed into the toner storage unit 30 in the same manner as with the first stirring rod 44. Because the length of the second stirring rod 45 is the same as the first stirring rod 44, the second flange 57 and the second seal 58 are disposed in the same relative position as on the first stirring rod 44 and therefore the same sealing effect is provided on fourth aperture 43.

After mounting first stirring rod 44 and second stirring rod 45 into toner storage unit 30 and filling the toner storage unit 30 with toner, an upper cap 59 (shown in FIG. 5) is attached to the top of the toner storage unit 30 by heat sealing, adhesives or by any other appropriate means.

Figure 8:
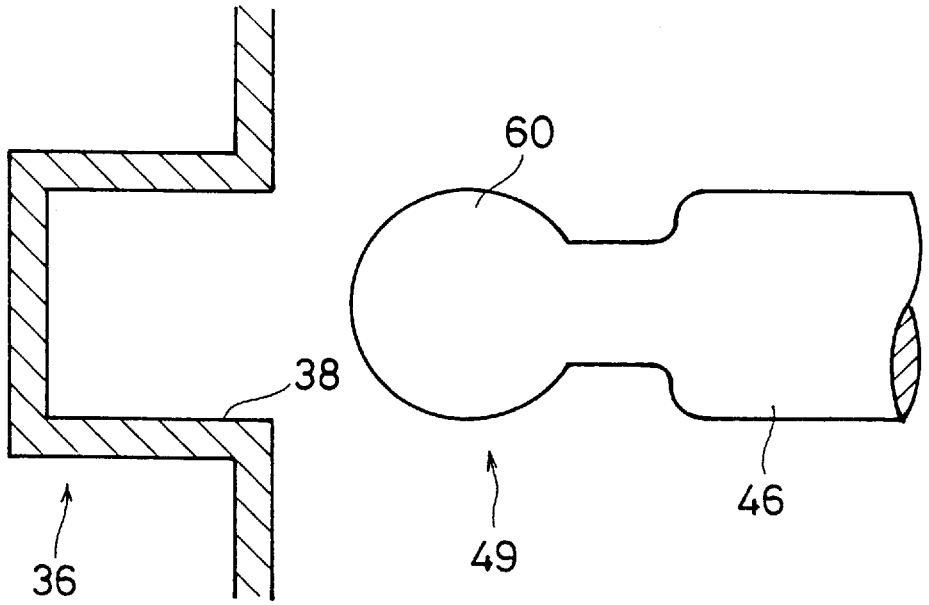
FIG. 8 is a part cross sectional, part perspective, part fragmentary view of a first bearing portion on a first side wall of a toner cartridge, and a first end portion of a first stirring rod, according to a second embodiment of the present invention.
Figure 9:
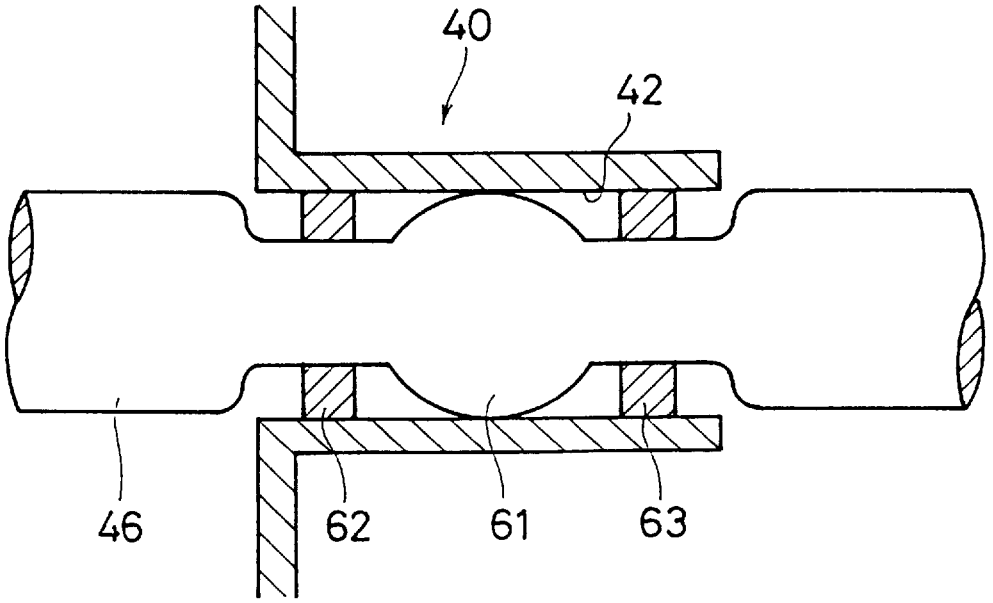
FIG. 9 is a part cross sectional, part perspective, part fragmentary view of a third bearing portion on a second side wall of the toner cartridge depicted in FIG. 8, and a second end portion of the first stirring rod depicted in FIG. 8.

The first and second bearing portions, as well as the ends of the first and second stirring rods, may be modified according to a second embodiment shown in FIGS. 8 and 9. In this second embodiment, the image forming device and the toner cartridge are identical in all respects to that disclosed above, except for the first aperture 38 and the second aperture 39, and the first rotating axis 46 and second rotating axis 53.

As shown in FIG. 8, the first bearing portion 36 is generally rectangular in shape, and includes a first aperture 38. The inner diameter of the first bearing portion is slightly larger than the diameter of a first end portion 49 of the first rotating axis 46. The first end portion 49 includes a generally spherical tip 60 which is connected to the rest of the first rotating axis 46 by a section having a narrower diameter than the rest of the first rotating axis 46. As with the previous embodiment, the first bearing portion 38 supports the first rotating axis 46 when installed therein, and because the first end portion 49 is generally spherical, the amount of friction generated between the first bearing portion 38 and the first rotating axis 46 can be kept to a minimum. A second aperture (not shown) is disposed in the same place as the second aperture 39 of the previous embodiment, and is identical in shape and function to the first aperture 38. A first end portion (not shown) on the second rotating axis 53 is identical in shape and function to the first end portion 49 of the first rotating axis 46.

As shown in FIG. 9, a second end portion of the first rotating axis 46 includes a generally spherical portion 61 which is separated by two sections having a narrower diameter than the rest of the first rotating axis 46. Two rubber seals 62, 63 extend around the first rotating axis 46 on either side of the spherical portion 61. As with the previous embodiment, the third bearing portion 40 supports the first rotating axis 46 when installed. The spherical portion 61 on the first rotating axis 46 allows the amount of friction generated between the second bearing portion 40 and the first rotating axis 46 to be kept to a minimum. In addition, both the rubber seals 62, 63 and the spherical portion 61 prevent the leakage of toner through the the third bearing portion 40. A second end portion (not shown) of the second rotating axis 53 is identical in shape and function to the second end portion of the first rotating axis 46.

It should also be noted That the developing device 9, the cleaning device 11, and the toner hopper 24 can include one or more of the first stirring rods 44 or the second stirring 45 within their respective structures, or include another type of stirring rod different in shape but similar in flexibility. However, because the developing device 9, the cleaning device 11 and the toner hopper 24 can all act as a toner storing device during their operation, they can leak toner just like the toner cartridge 25 if not assembled in the manner outlined above. Therefore it is preferable that the developing device 9, the cleaning device 11, and the toner hopper 24 are assembled in a manner similar to the toner cartridge 25 when one or more stirring rods are incorporated therein.

Various details of the invention may be changed without departing from its spirit nor its purpose. Furthermore, the present invention is provided for the purpose of illustration only, and nor for the purpose of limiting the invention as defined the appended claims and their equivalents.

What is claimed is:

1. A toner cartridge for an image forming apparatus comprising:

a toner storage unit which includes a first side wall and a second side wall, wherein said first side wall includes at least one first bearing portion, said second side wall includes at least one second bearing portion, said first bearing portion being open to an interior of said toner storage unit but being closed to an exterior of said toner storage unit, and said second bearing portion extends through said second side wall;

at least one flexible stirring rod disposed within said toner storage unit, said stirring rod including a first end portion and a second end portion, said first end portion rotatably supported by said first bearing portion, and said second end portion rotatably supported by said second bearing portion and extending through said second side wall;

wherein said first end portion of said stirring rod is tapered to an angle $\theta_2$, and interior walls of said first bearing portion are tapered to an angle of $\theta_1$, said angle $\theta_2$ being greater than said angle $\theta_1$ such that engagement between said interior walls and said first end portion of said stirring rod is in generally radial directions with respect to said flexible stirring rod.

2. The toner cartridge according to claim 1, wherein said stirring rod is installed into said toner cartridge by inserting said first end portion into said first bearing portion, flexing said first stirring rod, and then inserting said second end portion through said second bearing portion.

3. The toner cartridge according to claim 1, wherein said stirring rod is installed into said toner cartridge by inserting said second end portion into said toner cartridge and through said second bearing portion, flexing said second stirring rod, and then inserting said first end portion into said first bearing portion.

4. The toner cartridge according to claim 1, wherein said first side wall includes two first bearing portions, and said second side wall includes two second bearing portions.

5. The toner cartridge according to claim 1, further comprising a second stirring rod.

6. The toner cartridge according to claim 1, wherein said stirring rod further comprises a rotatable rod, and a spiral-shaped member fixed around the outer circumference of said rotatable rod.

7. The toner cartridge according to claim 1, wherein said stirring rod further comprises a rotatable rod, and a paddle member fixed to said rotatable rod.

8. The toner cartridge according to claim 1, wherein said stirring rod is composed of a resilient material.

9. The toner cartridge according to claim 1, wherein said stirring rod further includes a flange member attached to said second end portion.

10. The toner cartridge according to claim 9, wherein a seal member is disposed between said flange member and said second side wall.

11. A toner cartridge for a image forming apparatus, comprising:

a toner storage unit which includes a first side wall and a second side wall, wherein said first side wall includes at least one first bearing portion, said second side wall includes at least one second bearing portion, said first bearing portion being open to an interior of said toner storage unit but being closed to an exterior of said toner storage unit, and said second bearing portion extends through said second side wall; and at least one flexible stirring rod disposed within said toner storage unit, said stirring rod including a first end portion and a second end portion, said first end portion being formed with a generally spherical portion on a tip thereof and rotatably supported by said first bearing portion, and said second end portion rotatably supported by said second bearing portion and extending through said second side wall such that engagement between interior walls of said first bearing portion and said spherical portion is in generally radial directions with respect to said flexible stirring rod.

12. The toner cartridge according to claim 11, wherein said second end portion of said stirring rod includes a generally spherical portion, and said spherical portion is supported by and in contact with said second bearing portion.

13. The toner cartridge according to claim 11, wherein said second end portion of said stirring rod further includes at least one seal member disposed adjacent to said spherical portion.

14. The toner cartridge according to claim 11, wherein said stirring rod is installed into said toner cartridge by inserting said first end portion into said first bearing portion, flexing said first stirring rod, and then inserting said second end portion through said second bearing portion.

15. The toner cartridge according to claim 11, wherein said stirring rod is installed into said toner cartridge by inserting said second end portion into said toner cartridge and through said second bearing portion, flexing said second stirring rod, and then inserting said first end portion into said first bearing portion.

16. The toner cartridge according to claim 11, wherein said first side wall includes two first bearing portions, and said second side wall includes two second bearing portions.

17. The toner cartridge according to claim 11, further comprising a second stirring rod.

18. The toner cartridge according to claim 11, wherein said stirring rod further comprises a rotatable rod, and a spiral-shaped member fixed around the outer circumference of said rotatable rod.

19. The toner cartridge according to claim 11, wherein said stirring rod further comprises a rotatable rod, and a paddle member fixed to said rotatable rod.

20. The toner cartridge according to claim 11, wherein said stirring rod is composed of a resilient material.

* * * * *